US005839590A

United States Patent [19]

Weiner

[11] Patent Number: 5,839,590

[45] **Date of Patent: *Nov. 24, 1998**

[54] PYRAMIDAL RECEPTACLES

[75] Inventor: Douglas S. Weiner, Twinsburg, Ohio

[73] Assignee: Pyram-Ad Corporation, Twinsburg, Ohio

[ * ] Notice: The term of this patent shall not extend beyond the expiration date of Pat. No. 5,628,396.

[21] Appl. No.: 519,296

[22] Filed: Aug. 25, 1995

[51] Int. Cl.[6] ..... B65D 6/16

[52] U.S. Cl. ..... 206/577; 220/910; 229/116

[58] Field of Search ..... 220/910, 908; 229/115, 116; 206/216, 577, 232

[56] References Cited

U.S. PATENT DOCUMENTS 490,680 1/1893 Roberts ..... 229/116

3,359,657 12/1967 Hedberg ..... 229/116 X 4,237,097 12/1980 McDuffie ..... 229/116 X 4,798,747 1/1989 Lasamee ..... 229/116 X

*Primary Examiner*—Jacob K. Ackun

*Attorney, Agent, or Firm*—Calfee, Halter & Griswold LLP

[57] ABSTRACT

A combined receptacle and advertising display in generally pyramidal configurations with an accessible internal cavity for receiving articles and external display surfaces for carrying communicative media such as advertising. The receptacle cavity is accessed through apertures in one or more triangular side panels. The receptacle can be emptied through an openable base panel or openable top. Extra-dimensional media may be attached to the exterior surfaces of side panels.

16 Claims, 13 Drawing Sheets

PYRAMIDAL RECEPTACLES

FIELD OF THE INVENTION

The present invention pertains generally to receptacles and advertisement displays and, in particular, to receptacles which have a dual function of containing articles and displaying advertising.

BACKGROUND OF THE INVENTION

Receptacles for discarded items, such as waste baskets, ash trays, trash cans and recycling bins are typically formed in certain common configurations and shapes such as generally cylindrical or rectangular with an open top and may be provided with a cover or openable lid. These shapes and configurations are dictated by volume requirements and ease of manufacture and use, and not necessarily by aesthetic or novelty or other functional considerations. Because receptacles are ubiquitous, they provide an ideal medium for carrying advertising displays. However, prior art receptacles are generally not constructed or contoured to optimize visibility of advertising displays which could be applied to the exterior.

With the elimination of ashtrays from a large percentage of restaurant table tops, there is a newly created need for a receptacle for such things as chewing gum, sugar packets and straw wrappers. For chewing gum in particular, the inadequacy of ashtrays as a receptacle is illustrated by the presence of gum stuck to the underside of restaurant tables everywhere. Ideally, such a receptacle would be aesthetically pleasing, have a substantially enclosed waste cavity, and occupy no more space than an ashtray.

Foldable articles made of paper board or other foldable material are used as advertising displays for table tops in restaurants. Such articles are typically folded to have a base and two display surfaces upon which an advertisement is printed. For example, the common "tent" table top display is formed of a single piece of card stock folded in half with the end of each half folded inward to form an interlocking base. The tent thus provides two generally vertically oriented display panels which carry a printed advertisement. Though three dimensional, such tents have only two display surfaces and do not serve as waste receptacles.

SUMMARY OF THE INVENTION

The present invention provides novel receptacle structures of unique configurations having distinct appearances and especially suited for carrying advertising material on external surfaces.

In accordance with one aspect of the invention, a pyramidal receptacle in the form of a polyhedron is provided having a polygonal base and a plurality of intersecting triangular panels connected to the base and terminating at a common vertex, and an access opening to an internal cavity of the receptacle for receiving articles. The plurality of upwardly angularly disposed walls in the manner of a pyramid are especially suited for carrying communicative media such as advertisement displays in an orientation highly visible to users of the receptacle.

In accordance with other aspects and embodiments of the invention, the access opening to the internal cavity of the receptacle may include an opening in one of the panels, or a removeable or openable top at or including the vertex of the intersecting panels. The receptacle may be formed of a relatively rigid material suitable for containing articles placed in the receptacle, such as metal or plastic or concrete, or of paper-based material foldable into the pyramidal configurations of the receptacle. The different embodiments of the pyramidal receptacle of the invention may be selectively dimensioned according to, for example, intended uses such as a table top receptacle, interior floor receptacle, exterior or public receptacle or recycling receptacle.

The present invention further provides a novel solution to the problem of restaurant table top waste management, and in combination with a novel table top advertisement format and related methods of use. In accordance with these aspects of the invention, a pyramidal table top receptacle having a polygonal base and a plurality of triangular intersecting panels which terminate at a common vertex, and an opening to an internal cavity of the receptacle is provided for receiving table waste such as chewing gum and straw wrappers and for carrying communicative media such as advertising on exterior surfaces of the panels.

In accordance with one particular embodiment of the invention, a combined receptacle and advertisement display is formed from a single sheet of foldable material having three fold lines which define adjoining edges of four generally rectangular interconnected panels including a central panel, a right panel connected along a first fold line to the central panel, a left panel connected along a second fold line to the central panel, and a bottom panel connected along a third fold line to the central panel; the right, left and bottom panels being foldable along respective fold lines relative to the central panel to form a three dimensional structure having a receptacle cavity and three advertising display surfaces. As described herein, additional embodiments of the invention include pyramidal receptacles with more than three panels, such as four, five, six, seven and eight or more panels; and cube and rectangular configurations with openings in one or more panels to an internal cavity.

These and other aspects of the present invention are herein fully disclosed in the following Detailed Description made with the reference to the annexed Figures.

DETAILED DESCRIPTION OF PREFERRED AND ALTERNATE EMBODIMENTS

Figure 1:
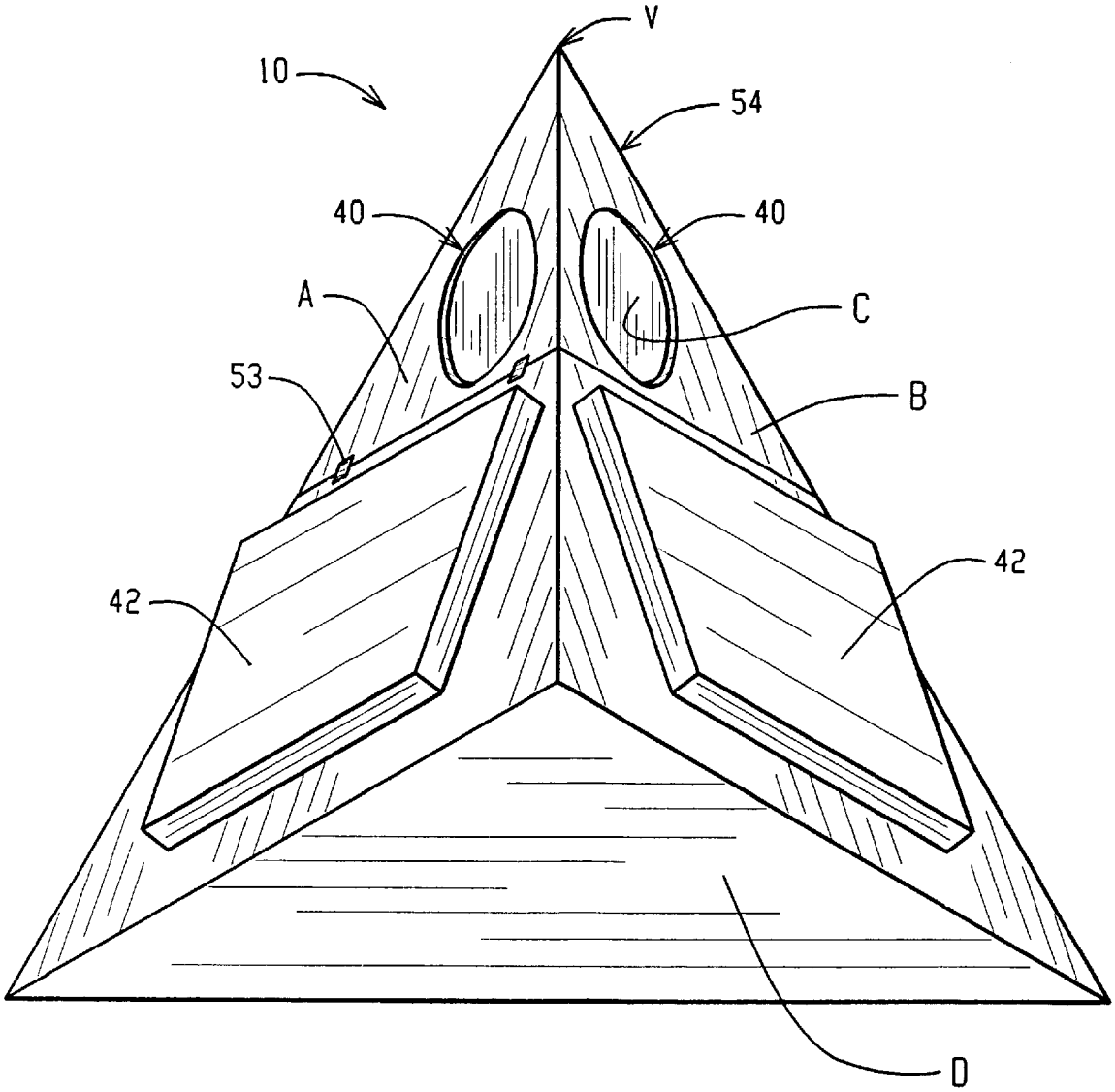
FIG. 1 is a perspective view of the Combined Receptacle and Advertisement Display of the present invention.
Figure 2:
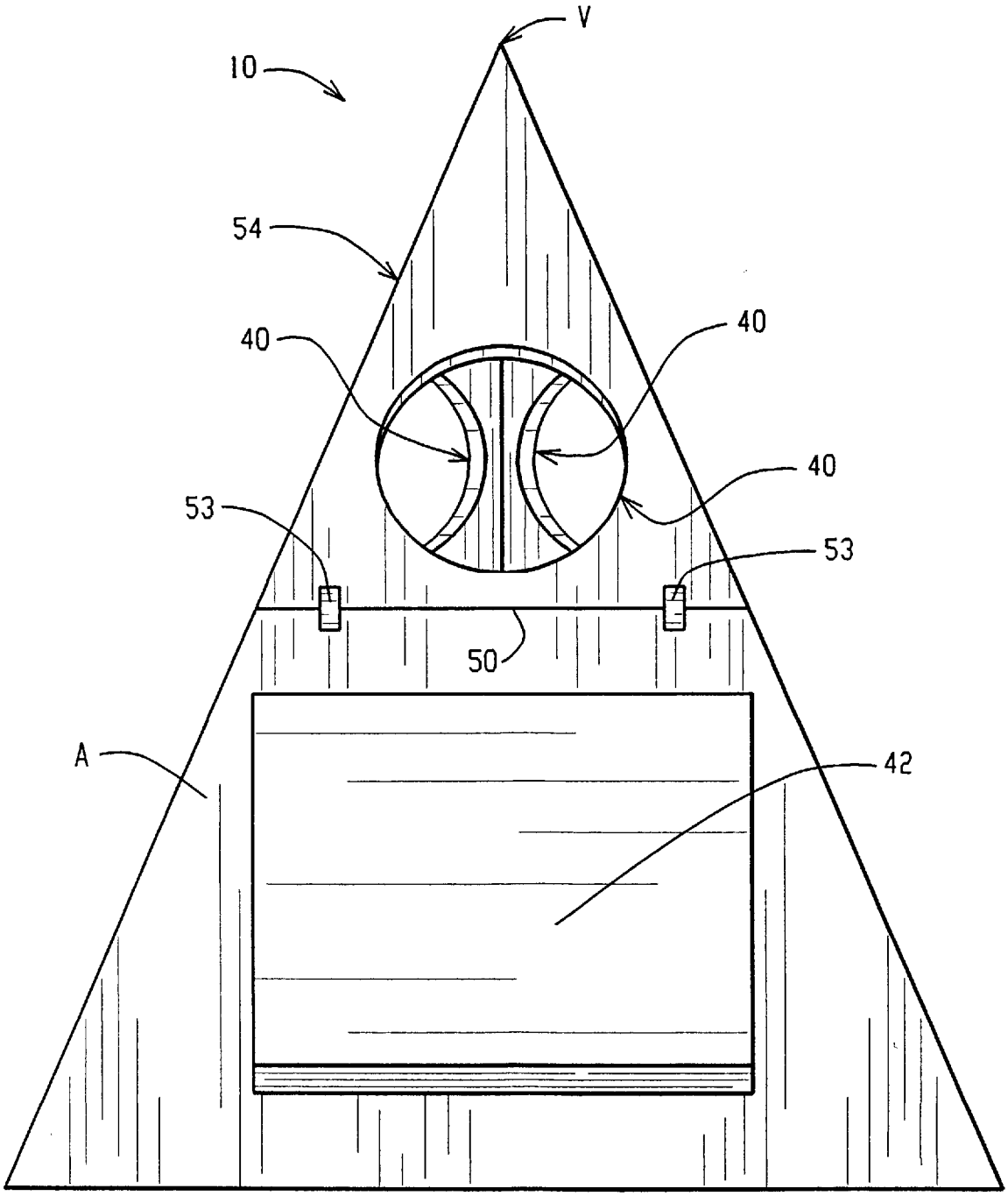
FIG. 2 is a side elevation of the Combined Receptacle and Advertisement Display of the present invention.
Figure 3:
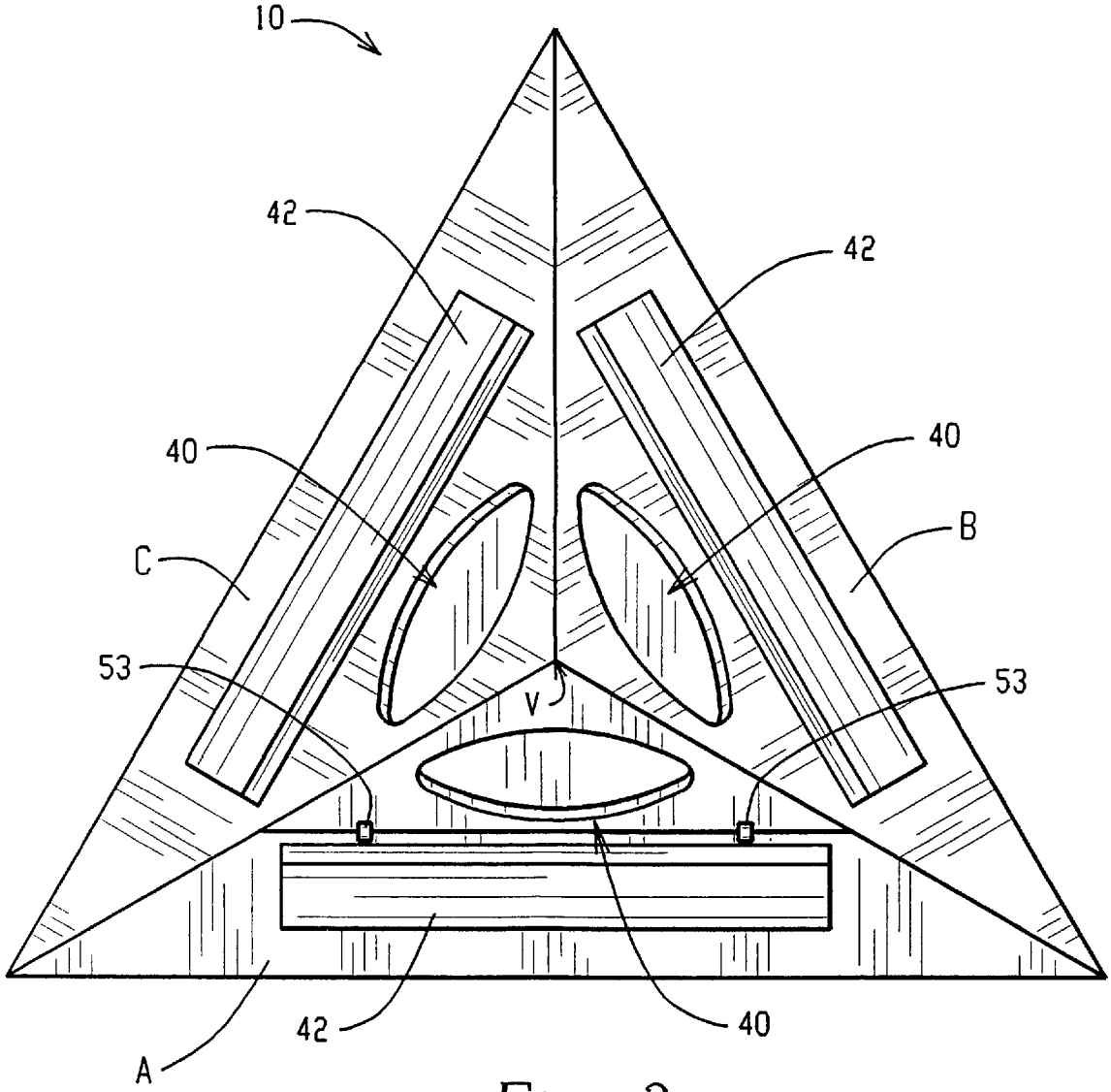
FIG. 3 is a top view of the Combined Receptacle and Advertisement Display of the present invention.

FIGS. 1 through 3 illustrate one embodiment of a pyramidal receptacle 10 of the invention which has the novel combination of elements of a polygonal base or bottom panel D, a plurality of intersecting triangular panels A, B and C which extend angularly vertically upward from base D to terminate at a common vertex V, thus forming a pyramidal polyhedron having an internal cavity accessible through an opening or aperture 40. In addition to the utility of the internal cavity for receiving articles and/or waste, the angularly disposed panels A,B and C are optimally oriented for highly visible presentation of communicative media such as advertising printed or otherwise applied to the exterior surfaces of the panels and/or attachment of media having additional dimension, such as tablets 42 or media support structures as further described below.

Each of the embodiments described herein may be selectively dimensioned according to intended usages such as, for example, without limitation, table or desk top receptacles, floor-based receptacles for interior use, ground-based receptacles for outdoor use such as public or private trash receptacles, recycling receptacles, etc. Any of the embodiments may be constructed or molded or formed of any suitable material for a given usage such as, for example, plastic, fiberglass, metal, steel, wood or paper-based material such as paperboard, cardboard, and composites of any materials such as polymer-coated papers and fiberglass reinforced plastics and polymers. Of course, when the receptacles are constructed of non-foldable material such as steel or concrete, the descriptions herein of receptacles having panels which are relatively foldable are not applicable, though all other principles apply. The descriptions of foldable receptacles contemplates any foldable material.

As further described below, the aperture or opening 40 may be selectively configured and located within a panel or panels also according to intended usages. As a non-limiting example, a pyramidal receptacle for receiving used beverage containers may have one or more relatively small apertures 40 located near the top of one or more panels, whereas a pyramidal receptacle for receiving paper may have a relatively larger aperture or apertures located somewhat more centrally within a panel or panels. Each of the panels may further include transverse cuts 50 to define a top portion 54 which is removable or openable relative to the remainder of the pyramid, as further described below, to provide even greater access to the interior of the receptacle. By this arrangement, additional containment vessels and/or plastic or paper liners may be used in combination with the receptacle such as placing a conventional garbage can within the pyramid base, or draping the top edge of a plastic garbage bag over the tops of the truncated pyramid panels to further contain articles passed through apertures 40. All such variations and modifications and methods of use are within the basic concept of the invention of a pyramidal receptacle having an accessible internal cavity and angular side panels adapted to carry and display advertising media.

Figure 4:
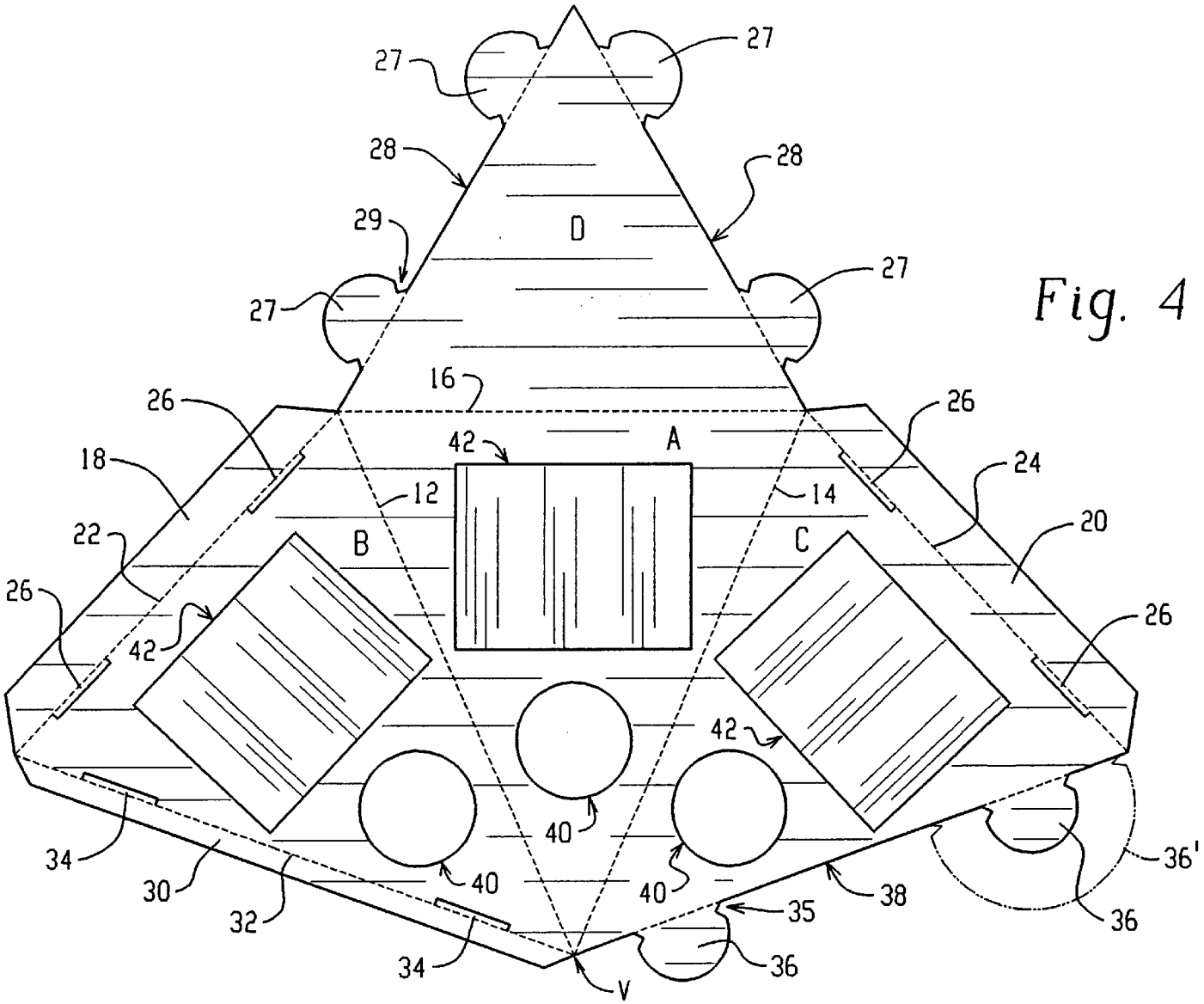
FIG. 4 is a plan view of the single sheet from which the Combined Receptacle and Advertisement Display of the present invention is formed.

The embodiment of FIGS. 1 through 3 may alternatively be executed as a preferred foldable form of the combined receptacle and advertising display 10 of the present invention which novelly provides a generally concealed waste receptacle and three distinct display panels or walls. The display 10 is formed from a single sheet 11 of card stock or any other suitable foldable material cut substantially in the unfolded configuration shown in FIG. 4 to include a central panel A, a right panel B, a left panel C and a bottom panel D. The four panels are interconnected along adjoining edges by respective fold lines 12, 14 and 16. In this particular embodiment, the length of fold lines 12 and 14 is substantially greater than fold line 16 in order to increase the height and volume of the waste receiving cavity without increasing the surface area of bottom panel D. Panels B and C further include foldable bottom flaps 18 and 20, respectively, attached to a bottom edge of the panel along respective fold lines 22 and 24. Locking tab insertion slots 26 are provided adjacent fold lines 22 and 24 to receive and engage locking tabs 27 which extend from peripheral edges 28 of panel D, in a manner well known in the foldable structure arts. Panel B further includes a foldable peripheral flap 30 attached to a peripheral edge of panel B along fold line 32. Locking tab insertion slots 34 are positioned adjacent fold line 32 to receive and engage locking tabs 36 which extend from peripheral edge 38 of panel C. Alternatively, tabs 36 may be substituted with a single somewhat larger tab 36' extending from peripheral edge 38 of panel C and distanced from vertex V and apertures 40 to avoid interference therewith. Locking tabs 36 may also be cut to have a relatively small locking notches 35 at the points of intersection of the tabs 36 with peripheral edge 38 to more securely engage ends of slots 34. Locking tabs 27 may similarly include locking notches 29. Adhesive may be applied to a surface of any portion of any panel, such as peripheral flap 30 for securement to an interior surface of the overlapping area of panel C.

To transform the display 10 into the three dimensional pyramidal folded configuration shown in FIGS. 1–3, peripheral flap 30 of panel B is first folded relative to panel B away from the exterior face of panel B. Panels B and C are then each folded relative to panel A, away from the exterior face of panel A, along fold lines 12 and 14 each to the extent that peripheral edge 38 meets fold line 32 with peripheral flap 30 tucked underneath panel C. Locking tabs 36 are inserted into slots 34. Bottom flaps 18 and 20 are then folded inward and panel D is also folded away from the face of panel A, to overlap bottom flaps 18 and 20 and position locking tabs 27 for insertion into slots 26. Apertures 40 may be selectively placed and shaped in panels A, B and C to provide access to the substantially enclosed waste receiving cavity formed by the described structure. The receptacle can be easily emptied by disengaging locking tabs 26 and opening panel D by hinged rotation along fold line 16. Furthermore, multiple assembled displays may be vertically stacked by similarly opening (or folding inward) bottom panel D to allow insertion of the point of another display.

The remaining exterior surface area of each panel is sufficient for attachment of an additional article or articles, which may be, for example, an advertising medium such as adhesively attached pieces of paper in the form of a miniature tablet 42 upon which messages may be printed and which may also be used to wrap waste material such as chewing gum prior to placing it in the receptacle. Other extra-dimensional articles may be attached to or otherwise incorporated in the side panels of the pyramid to attract attention to the advertisement display such as, for example without limitation, battery powered flashing light emitting diodes, electronic sound-generating chips and/or reflective or luminescent materials or fabric, etc.

Figure 5:
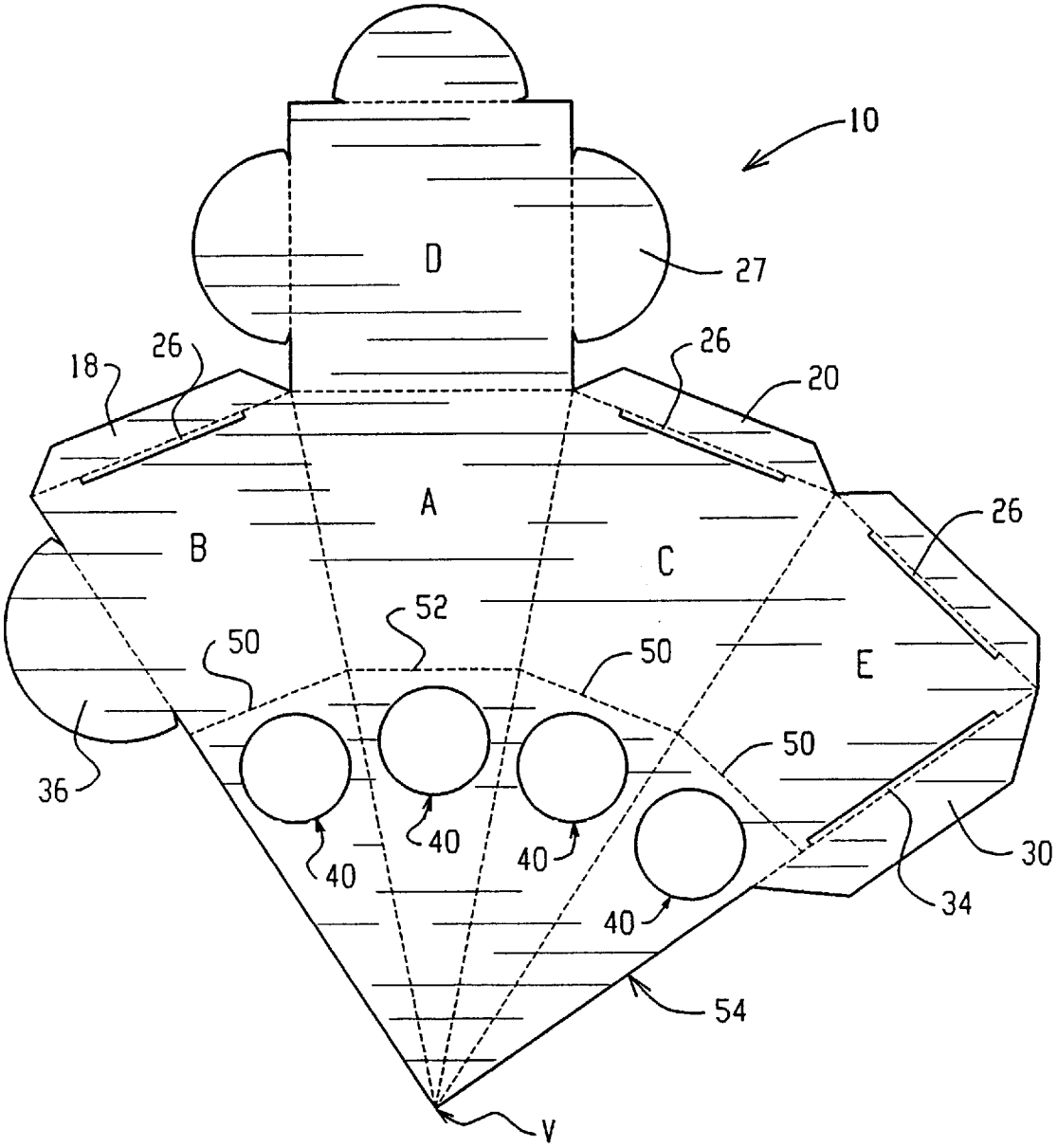
FIG. 5 is a plan view of an alternate embodiment of the invention in an unfolded configuration.
Figure 5A:
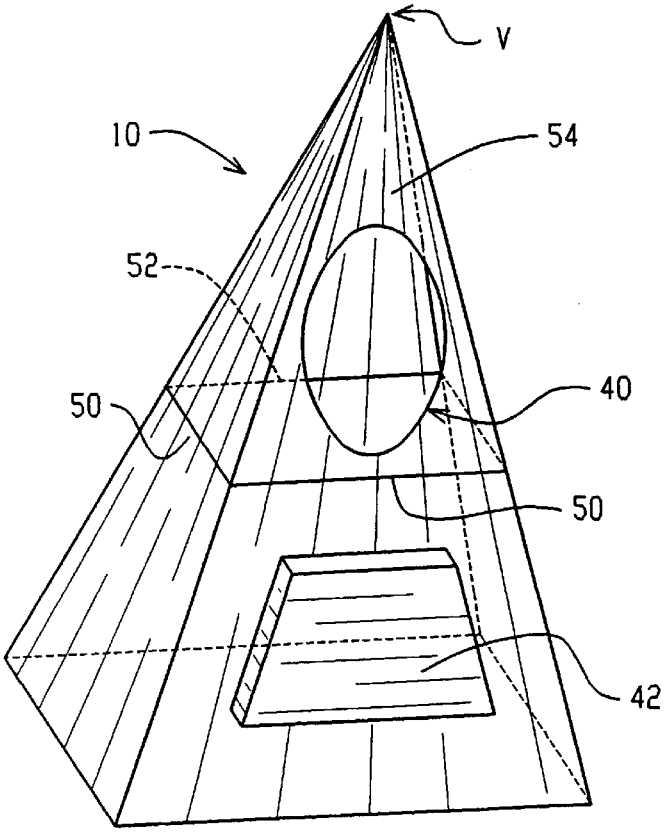
FIG. 5A is a perspective view of an alternate embodiment of the invention in a folded configuration.

FIGS. 5 through 9 and accompanying FIGS. 5A through 9A illustrate certain alternate embodiments of the foldable version of the pyramidal receptacle 10 (i.e., constructable of foldable material) in unfolded and folded configurations, with additional side panels to form four, five, six, seven and eight-sided pyramidal receptacles. As depicted in FIGS. 5A through 9A, each of these embodiments may also be formed in non-foldable materials or combinations of materials such as wood, steel, concrete, plastic or polymers or composite materials. Each of these embodiments has a base panel D and a central panel A attached to panel D, and are in most other respects substantially similar and consistent with the embodiment of FIGS. 1 through 4, including apertures 40 and attachment of extra-dimensional removable media such as miniature tablets 42 to the side panels. The embodiment of FIG. 5 includes an additional side panel E, which may also be provided with an aperture 40 of any desired shape, to form a four sided pyramid receptacle. The panels are relatively folded along the lines which interconnect the panels to form the pyramidal receptacle, as shown in FIG. 5A.

Additionally, in this and other embodiments, all panels but one may be transversely cut, for example along lines 50, with one panel such as A being scored along line 52 to provide for hinged opening of a top portion 54 of the pyramid, about line 52 to provide access to the interior of the receptacle for filling or emptying. The top portion 54 may or may not be provided with apertures 40. When constructed of non-foldable material, top portion 54 may be simply removable such as the lid to a trash can or otherwise hinged, for example by hinges 53, or removably attached and secured by latches or strapping.

The unobvious addition of panels in excess of three affords the functional advantage of increasing the number of advertising display surfaces. Also, a greater number of panels allows selected panels to be free of an aperture to thereby further increase advertising display area without limiting access to the cavity of the receptacle.

Figure 6A:
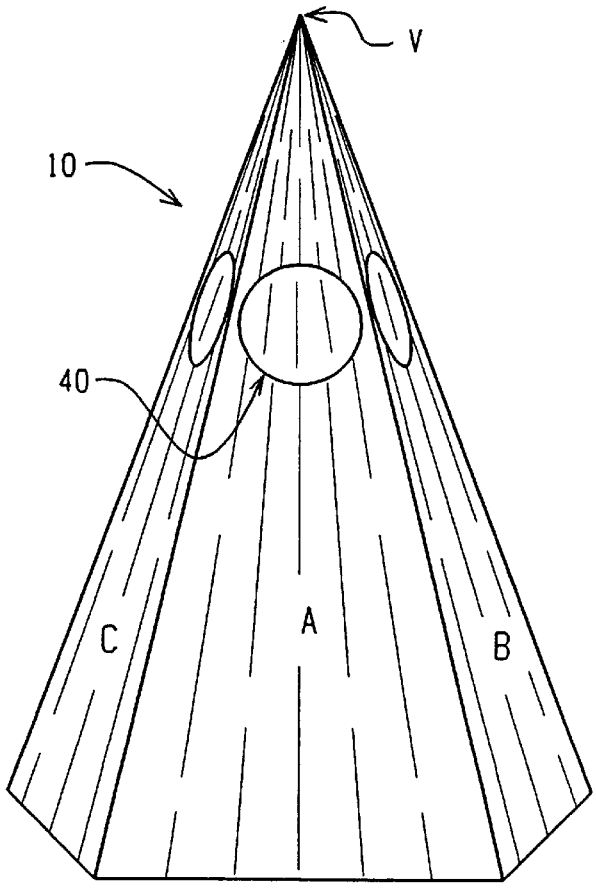
FIG. 6A is a perspective view of an alternate embodiment of the invention in a folded configuration.
Figure 6:
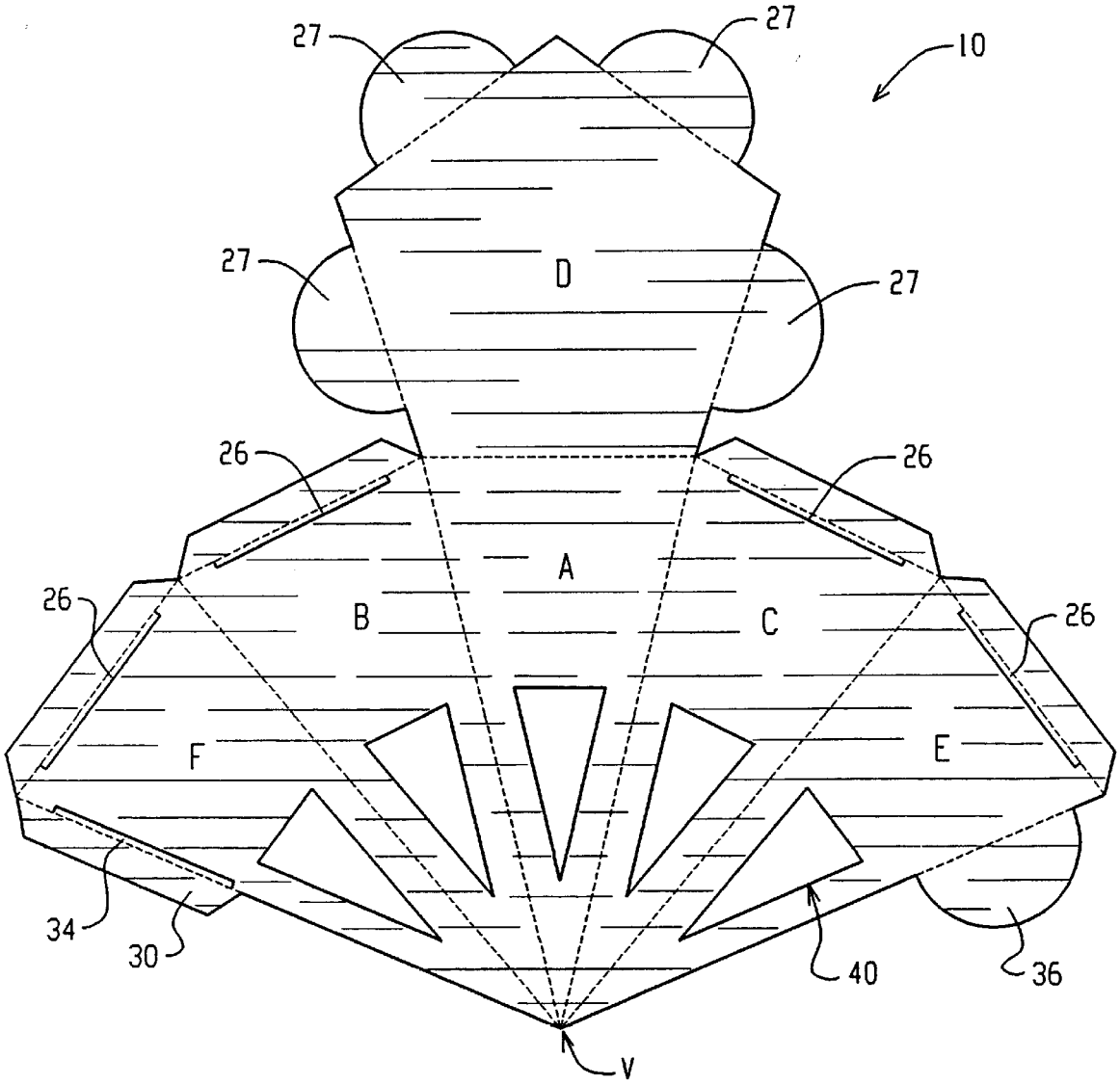
FIG. 6 is a plan view of a plan view of an alternate embodiment of the invention in an unfolded configuration.

FIG. 6 illustrates an embodiment of the receptacle 10 having five side panels A through F and a pentagonal base D. This embodiment is used to illustrate an alternate configuration of apertures 40 such as triangular with dimensions comparable to the side panels. Of course, this and all other alternate configurations of aperture 40 can be incorporated solely and in combination on any number of panels of any of the receptacle embodiments described. For example, FIG. 6A illustrates the embodiment of FIG. 6 in a folded configuration but with generally circular apertures in some side panels.

Figure 7:
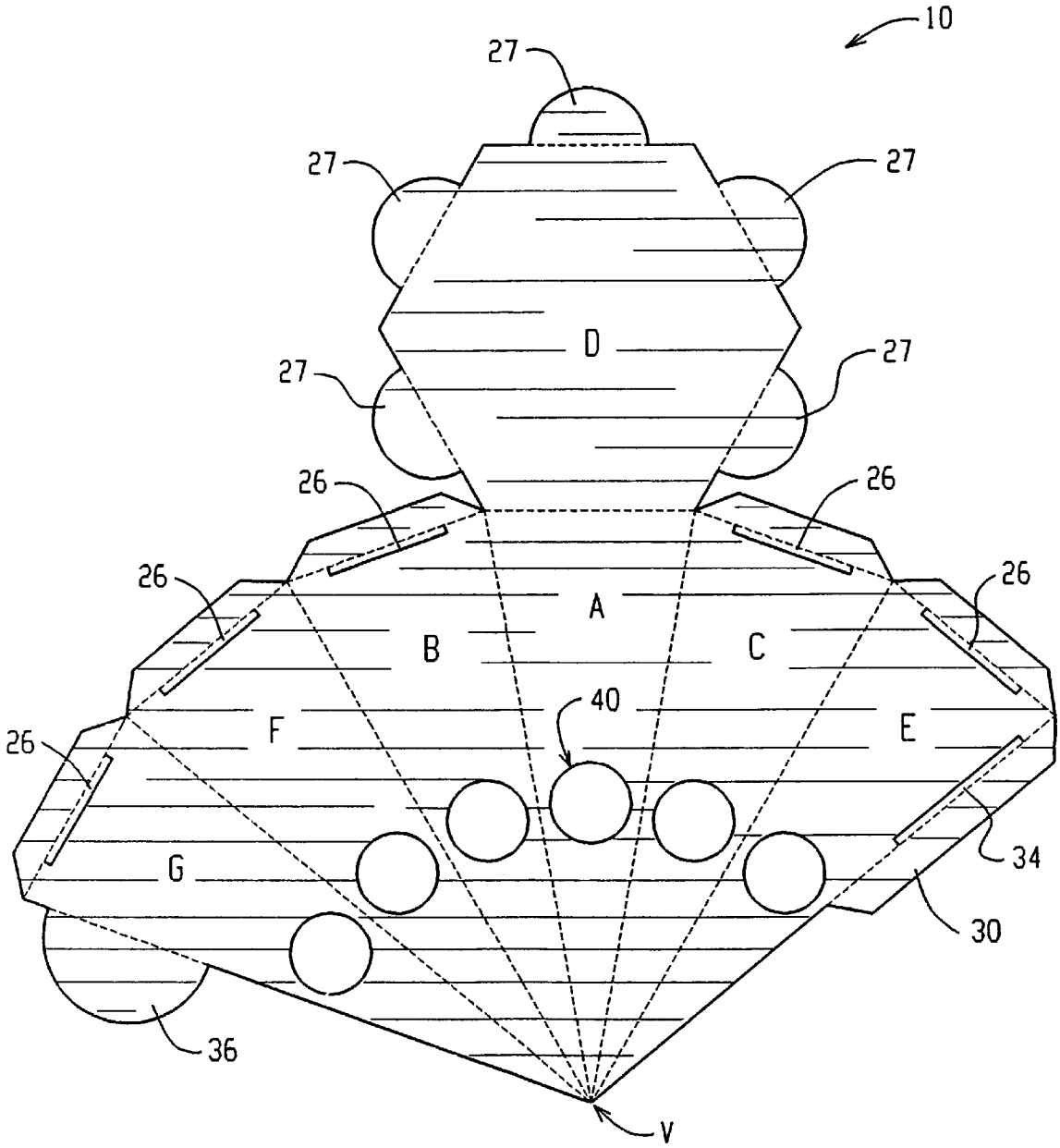
FIG. 7 is a plan view of a plan view of an alternate embodiment of the invention in an unfolded configuration.
Figure 7A:
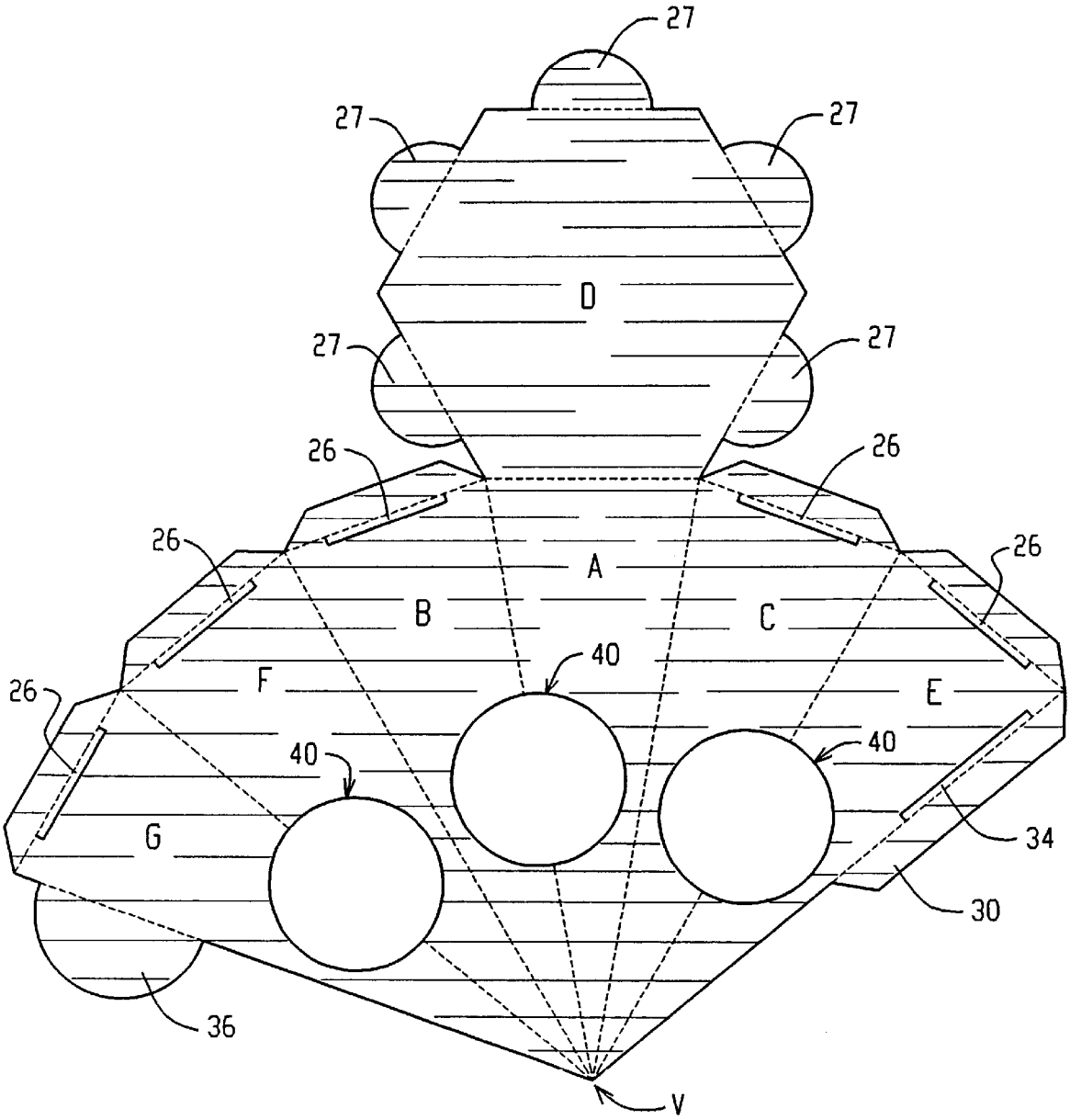
FIG. 7A is a plan view of a plan view of an alternate embodiment of the invention in an unfolded configuration.
Figure 7B:
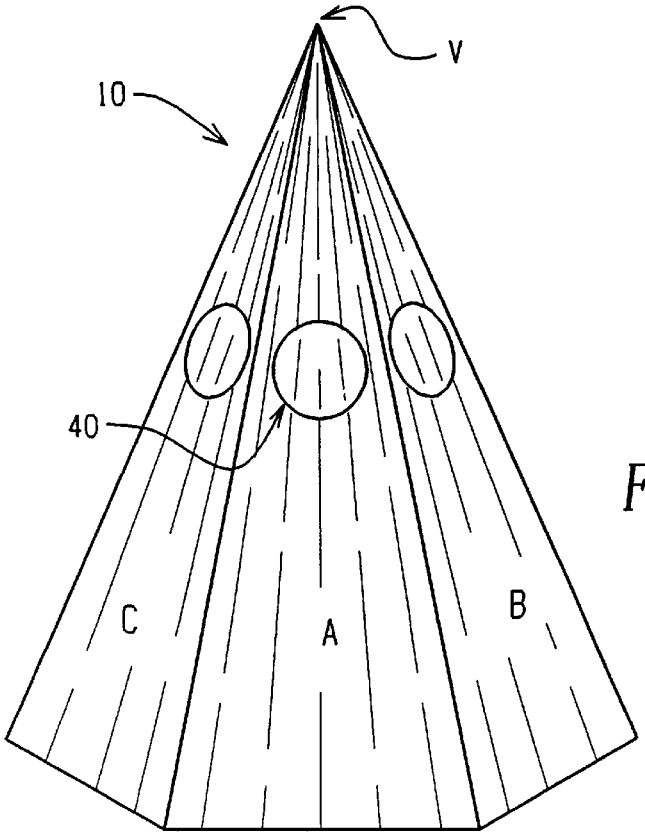
FIG. 7B is a perspective view of an alternate embodiment of the invention in a folded configuration.

FIG. 7 illustrates an alternate embodiment of the receptacle 10 having six side panels A through F and a hexagonal base D. FIG. 7A illustrates a still further variation of apertures 40 cut across an interconnecting fold line or lines so that the aperture is generally bisected by the fold line or lines and extends into the areas of two adjacent panels. Again the shape of aperture(s) 40 can be any shape which allows articles to be inserted into the cavity of the receptacle. FIG. 7B illustrates the six side panel embodiment in a folded configuration.

Figure 8A:
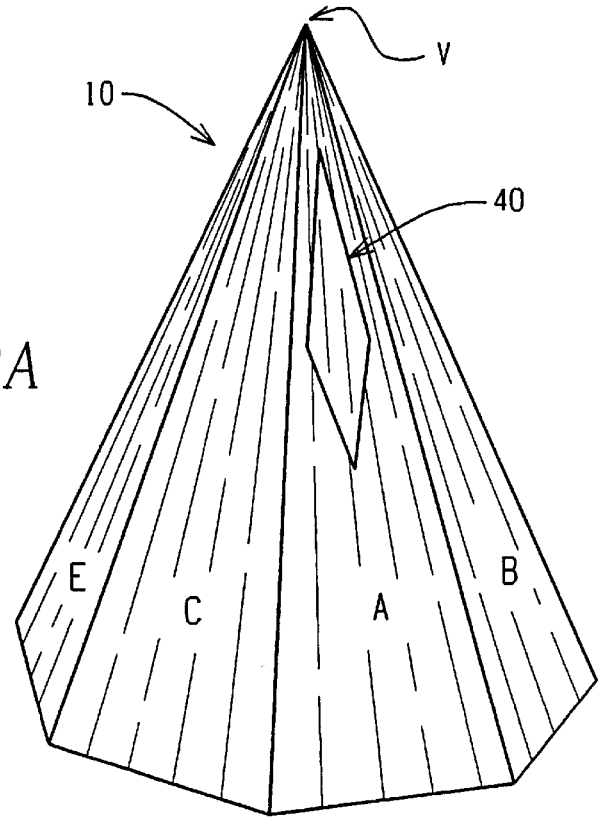
FIG. 8A is a perspective view of an alternate embodiment of the invention in a folded configuration.
Figure 8:
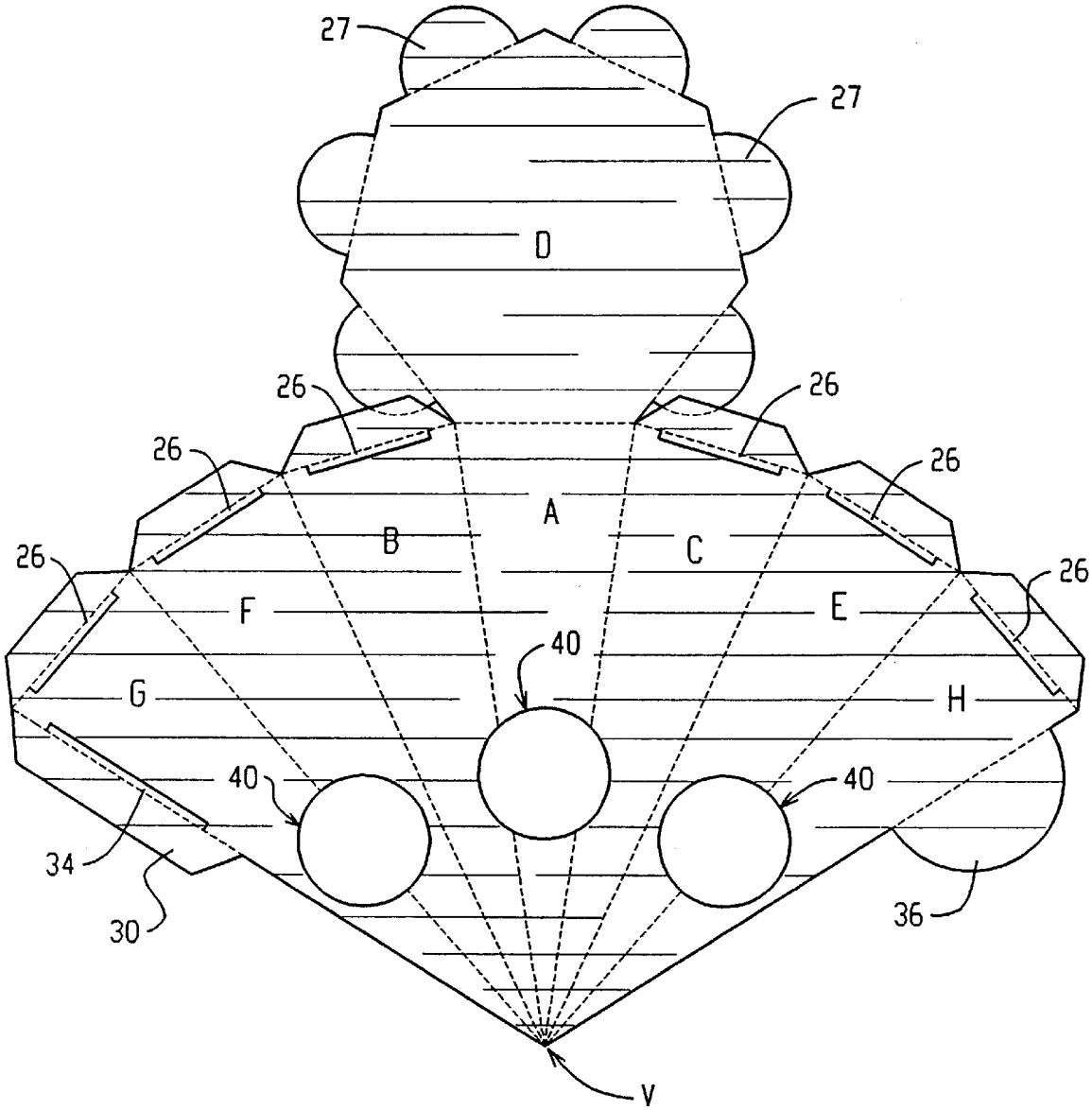
FIG. 8 is a plan view of a plan view of an alternate embodiment of the invention in an unfolded configuration.

FIG. 8 illustrates a seven side panel (A through G) embodiment of receptacle 10 and a septagonal base D. Central aperture 40 is cut across two fold lines to completely traverse panel A and extend into adjacent panels B and C. FIG. 8A illustrates this embodiment in a folded configuration with a diamond shaped aperture 40.

Figure 9:
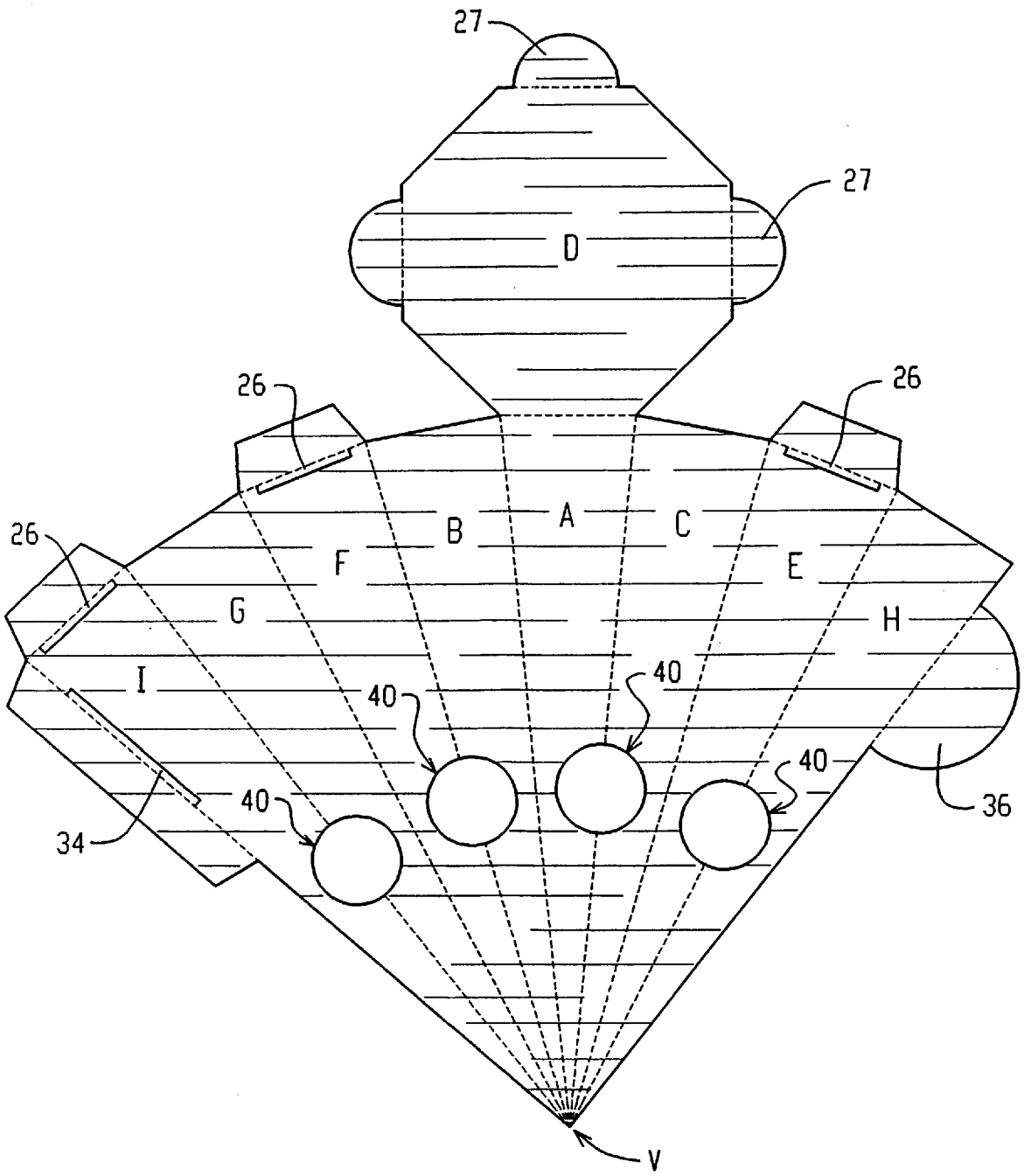
FIG. 9 is a plan view of a plan view of an alternate embodiment of the invention in an unfolded configuration.
Figure 9A:
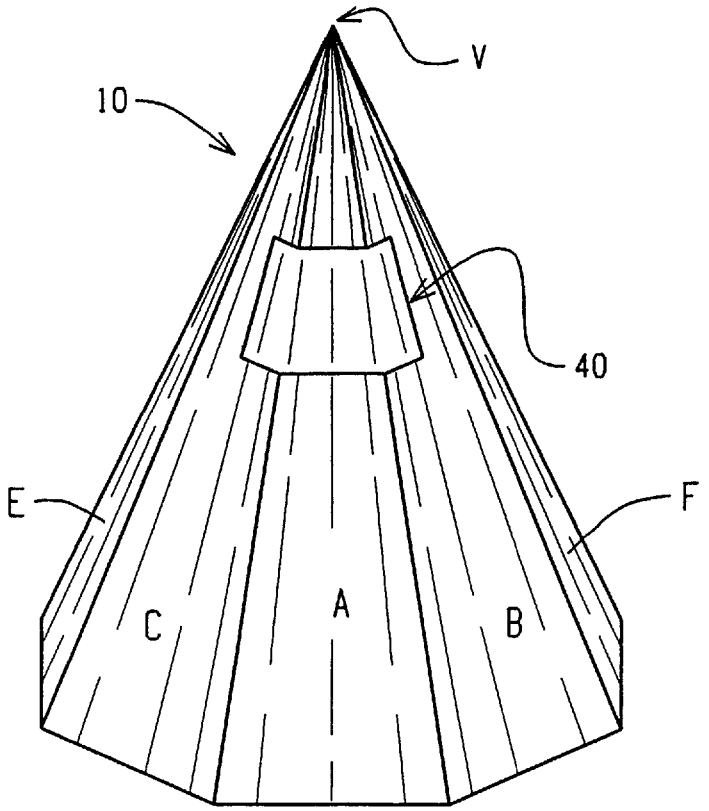
FIG. 9A is a perspective view of an alternate embodiment of the invention in a folded configuration.

FIG. 9 illustrates an eight side panel (A through I) embodiment of the receptacle 10 with octagonal base D. As shown in FIG. 9A, this embodiment is especially suited for apertures 40 which extend across multiple fold lines.

The invention thus provides a highly adaptable pyramidal receptacle having a utilitarian and accessible cavity and generally vertically oriented panels ideally suited for carrying printed messages and/or multi-dimensional advertisement displays. In usage, the receptacles are placed wherever containment of articles, including articles of trash, is required such as table and desk tops, offices, domestically, public areas and all sites of recycling collection. Any advertising or communicative media is applied to the exterior surfaces of the panels of the receptacle. Once the receptacle is filled through apertures 40 it is either discarded or emptied through openable panels or top portion 54.

Although the invention has been described in detail with reference to certain preferred and alternate embodiments, certain modifications and variations, such as for example the number of panels; number, size, shape and relative position of apertures, and overall dimensions, etc. not expressly disclosed are nonetheless within the concepts and principles of the invention as defined by the accompanying claims and equivalents thereto.

I claim:

1. A foldable advertising display stand and receptacle in the shape of a pyramid having an interior cavity within walls which form the pyramid shape, the display stand and receptacle comprising, a first triangular pyramid wall, a second triangular pyramid wall attached along a fold line to a first edge of the first pyramid wall, a third triangular pyramid wall attached along a fold line to a second edge of the first pyramid wall, and each of said walls foldable along respective fold lines and relative to the attached wall to form a pyramid, and edges of walls abutting in the pyramid formation and not connected by a fold line lockingly engaged, and at least one of the triangular pyramid walls having within an expanse of the wall between three edges of the wall a circuitous edge which defines a generally circular opening through the single layer thickness of the wall, through which the interior cavity is accessible, the wall being a single layer thickness about the circuitous edge which defines the generally circular opening.

2. The table top receptacle of claim 1 wherein a surface area of three of the panels is substantially equal and a surface area of the fourth panel is less than the surface area of the other three panels.

3. The table top receptacle of claim 1 further comprising an article attached to an exterior surface of at least one of the panels.

4. The table top receptacle of claim 1 further comprising a foldable flap along an edge of at least one of the panels, said foldable flap adapted to be folded to underlap an adjacent panel.

5. The receptacle of claim 1 constructed of plastic.

6. The receptacle of claim 1 further comprising an aperture in at least two side panels.

7. The receptacle of claim 1 further comprising transverse cuts in the side panels to form a removable top portion of the receptacle.

8. The receptacle of claim 1 further comprising transverse cuts in the side panels and a transversely disposed hinge mechanism in one of the panels whereby a top portion of the receptacle defined by the transverse cuts is openable about the hinge mechanism.

9.The receptacle of claim 1 further comprising an aperture which traverses a line of intersection of two side panels.

10. The receptacle of claim 1 further comprising extra-dimensional media attached to an exterior surface of a side panel.

11. The receptacle of claim 1 constructed of concrete.

12. The receptacle of claim 1 wherein lines of intersection of the panels are flexible to allow the panels to be relatively folded.

13. The receptacle of claim 1 further comprising locking tabs which extend from peripheral edges of the panels, and corresponding locking tab insertion slots adapted and positioned to receive locking tabs.

14. The receptacle of claim 1 further comprising adhesive applied to a panel for adhesive securement to another panel.

15. The receptacle of claim 1 constructed of steel.

16. The receptacle of claim 1 constructed of a polymer material.

* * * * *